US007436279B2

(12) United States Patent
Weger

(10) Patent No.: US 7,436,279 B2
(45) Date of Patent: Oct. 14, 2008

(54) HIGH VOLTAGE TRANSFORMER

(75) Inventor: Robert Weger, Wels (AT)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 11/893,555

(22) Filed: Aug. 15, 2007

(65) Prior Publication Data

US 2008/0048814 A1 Feb. 28, 2008

(30) Foreign Application Priority Data

Aug. 25, 2006 (DE) ..... 10 2006 040 024
Dec. 22, 2006 (DE) ..... 10 2006 062 205

(51) Int. Cl.
*H01F 27/28* (2006.01)

(52) U.S. Cl. ..... 336/180

(58) Field of Classification Search ..... 336/65, 336/83, 180–186, 220–222, 173
See application file for complete search history.

(56) References Cited

U.S. PATENT DOCUMENTS 7,183,889 B2 * 2/2007 Fushimi ..... 336/208
7,365,630 B1 * 4/2008 Yang et al. ..... 336/208
2006/0125591 A1 * 6/2006 Yang et al. ..... 336/208

* cited by examiner

*Primary Examiner*—Tuyen T. Nguyen
(74) *Attorney, Agent, or Firm*—Cooper & Dunham LLP

(57) ABSTRACT

The invention relates to a high voltage transformer having a double symmetric winding arrangement. The transformer comprises a closed core (10) having a first and a second leg (12, 14), a first and a second coil member (16; 18) having a first end, a second end and a middle section. Each coil member (16; 18) is wound with a first and a second primary winding (Prim 1, Prim 2 and Prim 3, Prim 4) and a first and a second secondary winding (Sec 1, Sec 2 and Sec 3, Sec 4), the first primary winding (Prim 1, Prim 2) being disposed at the first end and the second primary winding (Prim 3, Prim 4) at the second end of each coil member (16; 18) respectively. The first secondary winding (Sec 1, Sec 3) of each coil member (16; 18) is wound in the direction of the first end starting from the middle of the coil member, and the second secondary winding (Sec2, Sec 4) of each coil member (16; 18) is wound in the direction of its second end starting from the middle of the coil member, the winding direction of the first secondary winding (Sec 1, Sec 3) being opposite to the winding direction of the second secondary winding (Sec 2, Sec 4), and a first electric connection (HV12, HV34) being disposed in the middle of each coil member (16, 18).

11 Claims, 4 Drawing Sheets

HIGH VOLTAGE TRANSFORMER

BACKGROUND OF THE INVENTION

The invention relates to a high voltage transformer, as can be used, for example, in electronic circuits for the purpose of supplying power to the backlights in LCD displays. The invention applies particularly to the winding structure of high voltage transformers having chamber windings or segmented windings.

PRIOR ART

Cold cathode lamps are used, for example, as a backlighting source for LCD displays. In a cold cathode lamp circuit, a primary voltage of several tens of volts is transformed by a high voltage transformer into a secondary voltage of several hundreds to several Kilovolts (typically: 0.6-2 kV) in order to operate the cold cathode lamp. FIG. 6 shows this kind of high voltage transformer in a well-known construction. The transformer comprises a rectangular ferrite core 110 that is made up of two U-shaped cores. Two parallel legs 112, 114 are thus produced, on each of which a coil member 116 and 118 is disposed. A primary winding Prim 1 and a secondary winding Sec 1 are wound on the first coil member 116. A primary winding Prim 2 and a secondary winding Sec 2 is likewise wound on the second coil member 118. The secondary windings are segmented into a plurality of chambers that are separated from one another by insulated bridges 120. This goes to ensure that the difference in voltage between adjacent windings remains below a critical value (typically 200Vrms) to prevent dielectric breakout. The high voltage connections (the so-called "hot ends") HV1 and HV2 of the two secondary windings Sec 1 and Sec 2 are each disposed at the ends of the coil members 116, 118. The cold ends of the secondary windings are either connected to ground potential or to near ground potential to thus exclude the risk of spark formation.

The section of the windings having the highest voltage potential is vulnerable to spark formation to the core along the surface of the coil member. This risk is further intensified by the utilization of the transformers in an inverter for backlights due to the applied high frequency of the high voltage in the range of 30-70 kHz. In order to prevent spark formation caused by a difference in potential between the hot end of the high voltage secondary windings Sec 1, Sec 2 and the core 110, the coil members 116, 118 have to be designed such that there is a sufficient distance between the "hot" parts of the secondary windings and the core (called creepage distance). This measure, however, goes to increase the overall size of the transformer. This is especially problematic for applications for backlight inverters in which great value is attached to the miniaturization of all components.

Another solution according to the prior art is to encapsulate the problem areas or the entire transformer with epoxy resin.

According to the prior art, the high voltage windings can either be made using a layered winding method (layered windings with the individual layers being separated by insulting plastic strips), or using the chamber winding method. Due to cost advantages, chamber windings having one end at or near to ground potential are almost exclusively used for the miniaturized transformers in inverters for backlights.

SUMMARY OF THE INVENTION

It is the object of the invention to provide a high voltage transformer that has a small overall size and that fully excludes the typical problem areas for spark formation and surface discharge at the hot end of the high voltage winding.

This object has been achieved according to the invention by a high voltage transformer having the characteristics outlined in claim 1.

Preferred embodiments and further beneficial characteristics of the invention are cited in the subordinate claims.

In the transformer according to the invention, problem areas having a high difference in potential are avoided by using a special double symmetric winding arrangement. Further advantages of the proposed winding arrangement include reduced losses due to the proximity effect and the reduced height or overall size of this transformer. The last two advantages result from the partition of the primary and secondary windings into four part-windings having half the wire diameter.

The high voltage transformer comprises a closed core having a first and a second leg, a first coil member that is disposed on the first leg of the core and has a first end, a second end and a middle section, and a second coil member that is disposed on the second leg of the core and has a first end, a second end and a middle section. Each coil member is wound with a first and a second primary winding and a first and a second secondary winding, the first primary winding being disposed at the first end and the second primary winding at the second end of each coil member. The first secondary winding of each coil member is wound in the direction of the first end of the coil member starting at the middle of the coil member, and the second secondary winding of each coil member is wound in the direction of the second end of the coil member starting at the middle of the coil member, the winding direction of the first secondary winding being opposite to the winding direction of the second secondary winding. A first electric connection is disposed in the middle of each coil member.

In a preferred embodiment of the invention the adjacent, adjoining ends of the first and the second secondary winding of each coil member are connected to the first connection in the middle of the coil member. These ends of the winding have a high voltage potential.

The other end of the first secondary winding of each coil member, which has a low voltage potential, is connected to a second connection that is disposed at the first end of the coil member.

The low-voltage potential end of the second secondary winding of each coil member is connected to a third connection that is disposed at the second end of the coil member.

The windings can be wired in different ways depending on requirements.

The two secondary windings that are located on the same coil member must always be connected in parallel. Thus, electrically speaking each coil member has only one single secondary winding that consists mechanically of two parts.

Since the transformer according to the invention has two similar coil members in all, this also means a total of two secondary windings. These now have to be connected to their cold ends. It must be noted, however, that although according to FIG. 1 the coil members are the same, the winding directions of the individual windings are not.

When the winding direction is the same as that shown in FIG. 1, the same phase position and voltage occur at the two hot ends (HV12 and HV34) and the hot ends can be electrically connected. The secondary windings are now connected in parallel.

Another possibility is to use two coil members having an identical winding direction, as shown in FIG. 3. The cold ends of the secondary windings are again connected as shown in the first embodiment. Between the hot ends, however, the difference in voltage is now double due to the phase opposition of the windings on the two coil members. The secondary windings are now connected electrically in series.

The four primary windings of the two coil members can either be connected in parallel or in series, or partly in parallel and in series. This makes it possible to halve or quarter the transformation ratio.

Depending on the wiring of the primary windings, it is important to ensure that the winding directions of the primary windings are chosen such that the magnetic flux acts in the same direction.

Further preferred characteristics and advantages of the invention can be derived from the description below and the drawings.

DESCRIPTION OF A PREFERRED EMBODIMENT OF THE INVENTION

Figure 1:
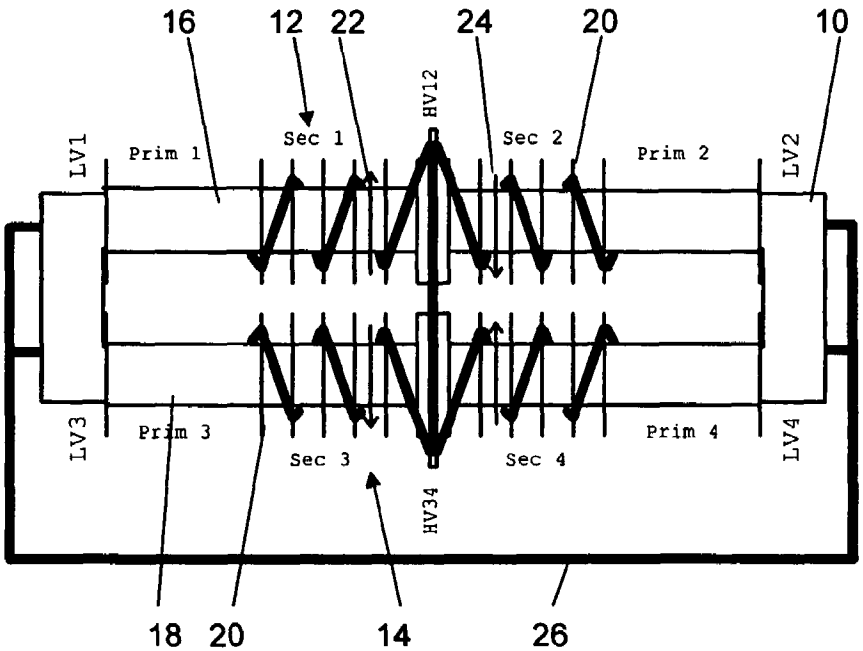
FIG. 1 shows a unipolar high voltage transformer according to the invention having a double symmetric winding arrangement.

FIG. 1 shows a high voltage transformer according to the invention in a unipolar design. The transformer comprises a rectangular ferrite core 10 that is made up of two U-shaped cores. Two parallel legs 12, 14 are thus produced on each of which a coil member 16 and 18 is disposed. Each coil member 16, 18 comprises a first end, a second end and a middle section. Two primary windings Prim 1, Prim 2 and two secondary windings Sec 1 and Sec 2 are wound on the first coil member 16. Two primary windings Prim 3 and Prim 4 and two secondary windings Sec 3 and Sec 4 are likewise wound on the second coil member 18. The path followed by the wire of the secondary windings is indicated schematically by reference number 26. In their middle section (along the longitudinal axis of the coil member), each of the coil members 16, 18 has a high voltage connection HV12 and HV34. The adjacent ends of the two secondary windings Sec 1, Sec 2 or Sec 3, Sec 4 of each coil member 16, 18 meeting n the middle are connected to the associated high voltage connection HV12 or HV34. Insulated bridges 20 can be provided between the individual windings and also the individual sections of the secondary windings.

The winding direction of the two secondary windings of each coil member run in the opposite direction as indicated by the arrows 22, 24 in the drawing and which can be seen from the path of the wire 26 as indicated. The ends of the secondary windings Sec 1, Sec 2, Sec 3 and Sec 4 having a low electric potential (cold ends) are connected to associated periphery connections LV1, LV2, LV3 and LV4 at the ends of the respective coil member, as is also known for transformers according to the prior art. These connections LV1, LV2, LV3 and LV4 can be electrically connected to external wiring such as the strip conductors of a printed circuit board. The two secondary windings Sec 1, Sec 2 or Sec 3, Sec 4 are thus electrically connected in parallel to each coil member 16, 18.

In the case of a unipolar transformer, according to FIG. 1, the secondary windings Sec 1, Sec 2 and Sec 3, Sec 4 of both coil members 16, 18 can be connected in parallel by external wiring, it being unnecessary to maintain a safe distance between the coil members 16, 18. The primary windings Prim 1 to Prim 4 could all be connected in series, for example.

Figure 2:
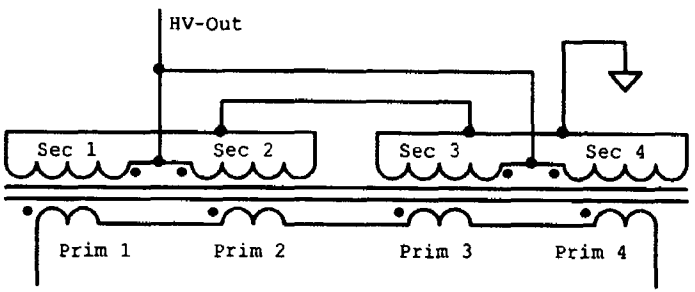
FIG. 2 shows the circuit of the unipolar transformer of FIG. 1.

FIG. 2 shows a possible circuit diagram of the unipolar transformer from FIG. 1.

Figure 3:
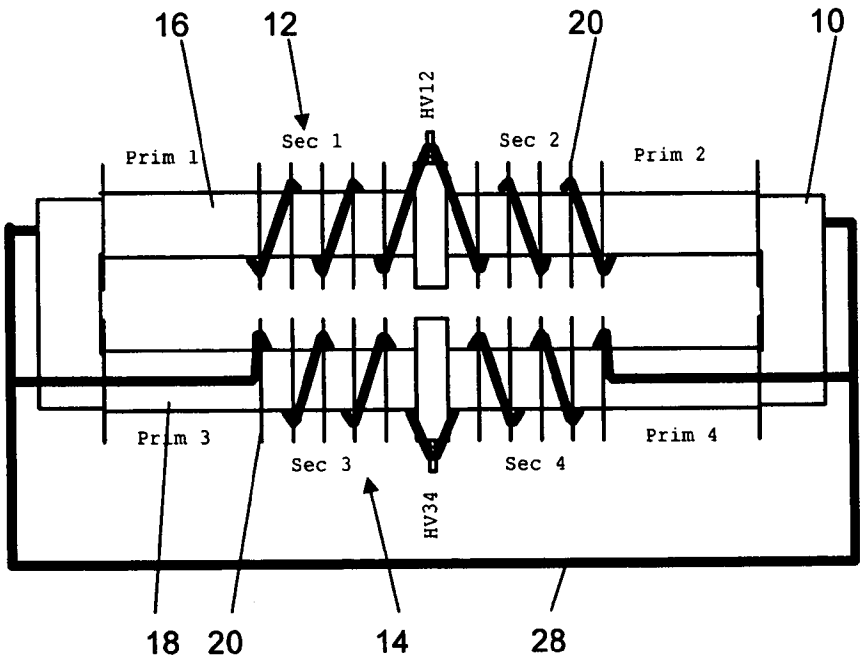
FIG. 3 shows a bipolar high voltage transformer according to the invention having a double symmetric winding arrangement.

In the case of a bipolar transformer, as illustrated in FIG. 3, a safe distance between the coil members 16, 18 must be provided. As can be seen from the schematic path of the wire 28, the cold ends of the secondary windings are again connected to one another, as in the first embodiment according to FIG. 1. Between the hot ends of the secondary windings, however, the difference in voltage is now double due to the phase opposition of the windings on the two coil members 16, 18. The secondary windings are now electrically connected in series.

Figure 4:
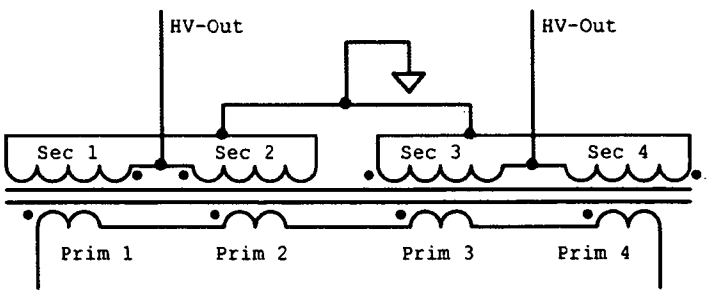
FIG. 4 shows the circuit of the bipolar transformer of FIG. 3.

FIG. 4 shows a possible circuit diagram of the bipolar transformer from FIG. 1.

The primary windings Prim 1, Prim 2, Prim 3, Prim 4 can either be connected in parallel or in series or partly in parallel and in series, depending on the required transfer ratio.

Figure 5B:
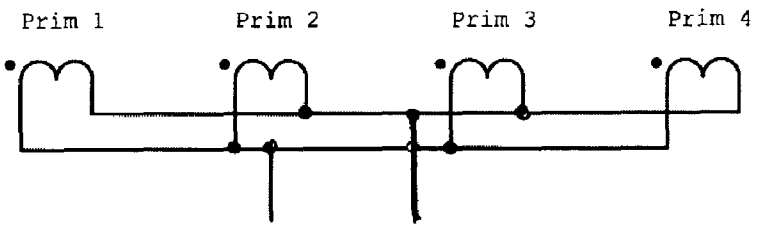
FIG. 5*b* shows a third means of interconnecting the primary windings of the transformers of FIGS. 1 and 3.
Figure 5A:
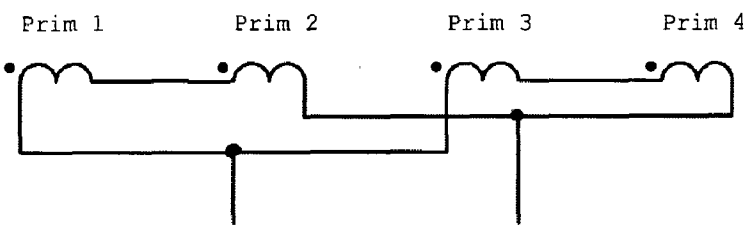
FIG. 5*a* shows a second means of interconnecting the primary windings of the transformers of FIGS. 1 and 3.
Figure 6:
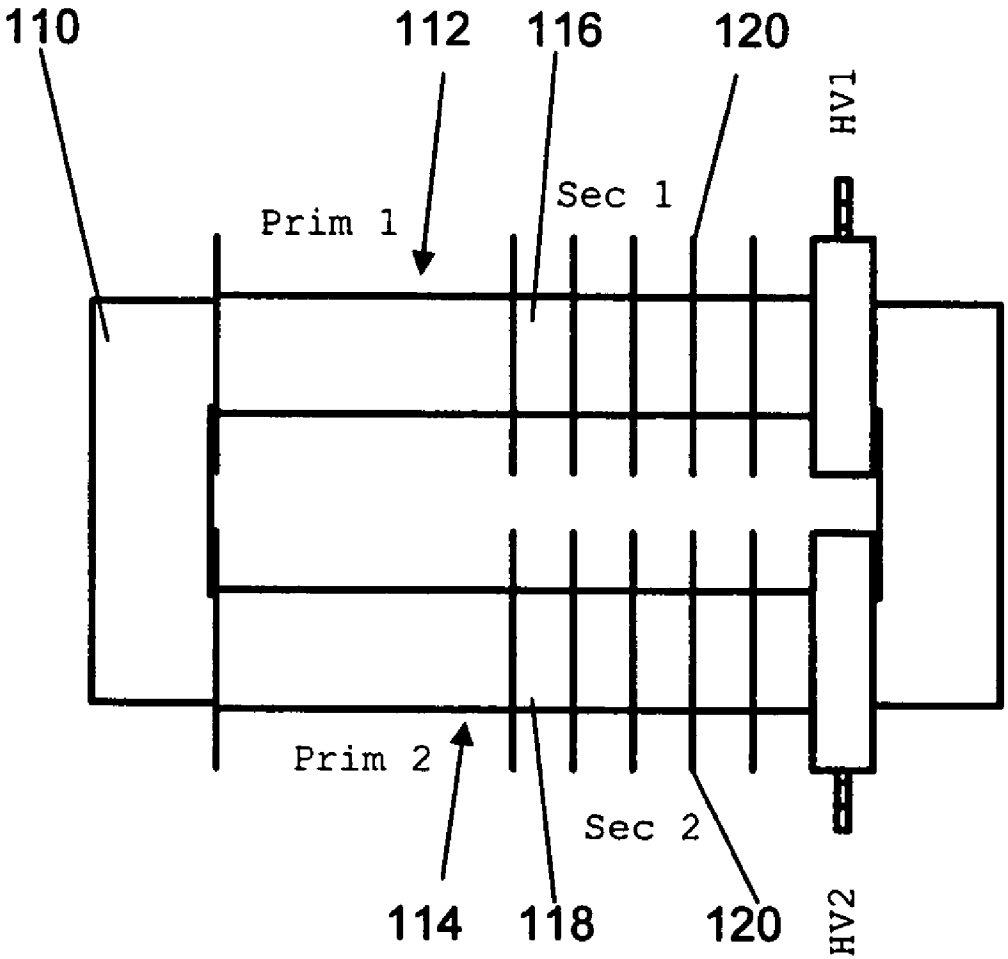
Fig. 6 PRIOR ART
FIG. 6 shows a high voltage transformer according to the prior art.

FIG. 5*a* shows primary windings Prim 1 and Prim 2 as well as Prim 3 and Prim 4 each connected in series. The two series connections are again connected in parallel.

FIG. 5*b* shows a connection in parallel of all four primary windings Prim 1 to Prim 4.

However, the polarity and winding direction must guarantee that the magnetic flux of all primary windings has the same direction. Each primary winding thus generates a magnetic flux in the core that acts in the same direction as the magnetic flux generated by the remaining primary windings.

IDENTIFICATION REFERENCE LIST

10 Ferrite core
12 Legs
14 Legs
16 Coil member
18 Coil member
20 Insulated bridges
22 Arrow indicating winding direction
24 Arrow indicating winding direction
26 Wire path (unipolar secondary circuit)
28 Wire path (bipolar secondary circuit)
110 Ferrite core
112 Legs
114 Legs
116 Coil member
118 Coil member
120 Insulated bridges

The invention claimed is:

1. A high voltage transformer comprising:

a closed core (10) having a first and a second leg (12, 14), a first coil member (16) that is disposed on the first leg (12) of the core (10) and that has a first end, a second end and a middle section, a second coil member (18) that is disposed on the second leg (14) of the core (10) that has a first end, a second end and a middle section, wherein each coil member (16; 18) is wound with a first and a second primary winding (Prim 1, Prim 2 and Prim 3, Prim 4) and a first and a second secondary winding (Sec 1, Sec 2 and Sec 3, Sec 4), wherein the first primary winding (Prim 1, Prim 3) is disposed at the first end and the second primary winding (Prim 2, Prim 4) at the second end of each coil member (16; 18), and the first secondary winding (Sec 1, Sec 3) of each coil member (16; 18) is wound in the direction of the first end starting from the middle of the coil member and the second secondary winding (Sec 2, Sec 4) of each coil member (16; 18) is wound in the direction of its second end starting from the middle of the coil member, wherein the winding direction of the first secondary winding (Sec 1, Sec 3) is the opposite of the winding direction of the second secondary winding (Sec 2, Sec 4), and a first electric connection (HV12, HV34) is disposed in the middle of each coil member (16; 18).

2. A high voltage transformer according to claim 1, characterized in that all the low-voltage ends (LV1, LV2, LV3, LV4) of the secondary windings (Sec 1, Sec 2, Sec 3, Sec 4) are electrically connected to one another.

3. A high voltage transformer according to claim 1, characterized in that the primary windings (Prim 1 to Prim 4) are electrically connected such that each one generates the same direction of magnetic flux in the core (10) as the remaining windings.

4. A high voltage transformer according to claim 1, characterized in that the ends of the first and the second secondary windings (Sec 1, Sec 2 or Sec 3, Sec 4) of each coil member (16; 18) having a high voltage potential are connected to the first connection (HV12 or HV34).

5. A high voltage transformer according to claim 1, characterized in that the end of the first secondary winding (Sec 1, Sec 3) of each coil member (16; 18) having a low voltage potential is connected to a second connection (LV1, LV3) that is disposed at the first end of the respective coil member(16; 18).

6. A high voltage transformer according to claim 1, characterized in that the end of the second secondary winding (Sec 2, Sec 4) of each coil member having a low voltage potential is connected to a third connection (LV2, LV4) that is disposed at the second end of the respective coil member (16; 18).

7. A high voltage transformer according to claim 1, characterized in that the winding directions of the secondary coils (Sec 1 and Sec 3) are opposite to each other and the winding directions of (Sec 2 and Sec 4) are also opposite to each other, which results in equiphase voltages of the same size at the first connections (HV12 and HV34).

8. A high voltage transformer according to claim 1, characterized in that the winding directions of the secondary coils (Sec 1 and Sec 3) are the same and the winding directions of (Sec 2 and Sec 4) are also the same, which results in antiphase voltages of the same size at the first connections (HVI2 and HV34), which corresponds to a connection in series of the secondary windings of both coil members (16, 18).

9. A high voltage transformer according to claim 1, characterized in that the primary windings (Prim 1, Prim 2 or Prim 3, Prim 4) of a coil member (16; 18) are connected in parallel.

10. A high voltage transformer according to claim 1, characterized in that the primary windings (Prim 1, Prim 2 or Prim 3, Prim 4) of a coil member (16; 18) are connected in series.

11. A high voltage transformer according to claim 1, characterized in that the primary windings (Prim 1, Prim 2; Prim 3, Prim 4) of the two coil members are partly connected in parallel and in series.

* * * * *